US006146584A

United States Patent [19]

Park et al.

[11] Patent Number: 6,146,584

[45] Date of Patent: Nov. 14, 2000

[54] MAGNESIUM ALLOY FOR A HIGH PRESSURE CASTING AND PROCESS FOR THE PREPARATION THEREOF

[75] Inventors: Sung-Jin Park, Ulsan; Jae Jhoong Kim, Pohang; Doe Hyang Kim, Seoul; Chul Soo Shin, Ulsan; Nak Jhoon Kim, Pohang, all of Rep. of Korea

[73] Assignee: Hyundai Motor Company, Ltd., Seoul, Rep. of Korea

[21] Appl. No.: 08/845,391

[22] Filed: Apr. 25, 1997

[30] Foreign Application Priority Data

Apr. 25, 1996 [KR] Rep. of Korea ..... 96-12885

[51] Int. Cl.[7] ..... C22C 23/04

[52] U.S. Cl. ..... 420/411; 148/420; 408/411

[58] Field of Search ..... 148/420; 420/408, 420/411

[56] References Cited

U.S. PATENT DOCUMENTS

| | | | |
|---|---|---|---|
| 3,291,656 | 12/1966 | Mann | 420/408 |
| 4,938,809 | 7/1990 | Das et al. | 148/406 |
| 5,078,962 | 1/1992 | Regazzoni et al. | 420/402 |

FOREIGN PATENT DOCUMENTS

| | | | |
|---|---|---|---|
| 903827 | 8/1962 | United Kingdom | 420/411 |
| 910981 | 11/1962 | United Kingdom | 420/411 |

*Primary Examiner*—John Sheehan

*Attorney, Agent, or Firm*—Birch, Stewart, Kolasch & Birch, LLP

[57] ABSTRACT

A magnesium alloy having a high strength and elongation, comprising by weight, 4.3–10.0% aluminum, 0.7–6.0% zinc, 0.4–5.0% silicon, 0.025–5.0% phosphorus, up to 0.7% copper, with the substantial balance being magnesium.

8 Claims, 4 Drawing Sheets

(1 of 4 Drawing Sheet(s) Filed in Color)

MAGNESIUM ALLOY FOR A HIGH PRESSURE CASTING AND PROCESS FOR THE PREPARATION THEREOF

BACKGROUND OF THE INVENTION

1. Field of the Invention

The present invention relates to a magnesium alloy for high pressure casting including a process for the preparation thereof, and more particularly to a magnesium-based alloy containing aluminum, zinc, silicon etc. in combination with phosphorus and copper for improving the strength and toughness thereof. Advantageously, the alloy of the present invention is used in a die-casting or squeeze-casting process.

2. Description of the Related Art

Various types of magnesium-based alloys are known in the art. Generally, magnesium-based alloys possess excellent strength and light weight and are used for regular casting and high pressure casting. Accordingly, the product made with magnesium-based alloys have been used in automobile parts and airplane parts.

Such conventional magnesium-based alloys contain, for example, 8.3–9.7 weight percent (hereinafter "W %") of aluminum, 0.35–1.0 W % of zinc, less than 0.15 W % of Manganese, less than 0.1 W % of silicon, and the remainder being magnesium; 5.5–6.5 W % aluminum, less than 0.22 W % of zinc, greater than 0.13 W % of manganese, less than 0.5 W % of silicon, and the remainder being magnesium; and 3.5–5.0 W % of aluminum, less than 0.12 W % of zinc, 0.2–0.5 W % of manganese, 0.5–1.5 W % of silicon and the remainder being magnesium. Such conventional magnesium-based alloys are satisfied with less than 0.005 W % of iron, less than 0.03 W % of copper, and less than 0.002 W % of nickel.

Also, U.S. Pat. No. 5,078,962 discloses high mechanical strength magnesium alloys and a process for manufacturing the same by rapid solidification and consolidation by drawing, generally exceeding 400 or 500 MPa, with an elongation at break of at least 5%. These alloys have a chemical composition of 2–11 W % of aluminum, 0–12 W % of zinc, 0–1 W % of manganese, and 0.1–4 W % of rare earth elements, with the main impurities and residue being magnesium.

However, these conventional magnesium-based alloys suffer from a number of problems such as, for example, they have a low strength when subjected to high elongation, they have a low elongation if they have high strength, and thus they do not have high strength and elongation.

SUMMARY OF THE INVENTION

Accordingly, it is an object of the present invention to provide an improved magnesium alloy for high pressure casting and a process for the manufacture thereof, which eliminates the above problems encountered with respect to conventional magnesium alloys and their processes.

Another object of the present invention is to provide a magnesium alloy comprising 4.3–10.0 W % of aluminum, 0.7–6.0 W % zinc, 0.4–5.0 W % of silicon, 0.025–5.0 W % of phosphorus, and up to 0.7 W % of copper, e.g. 0.1–0.7 W % of copper, with the substantial balance being magnesium, and possessing high strength and toughness for die-casting or squeeze-casting, and used in automobile and airplane parts.

A further object of the present invention is to provide a process for the preparation of a magnesium-based alloy which comprises adding 0.025–5.0 W % of phosphorus and up to 0.7 W % of copper to an alloy of magnesium, aluminum, zinc and silicon to produce a high strength and tough magnesium alloy by controlling the needle-shaped structure of $Mg_2Si$.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a magnesium alloy comprising 4.3–10.0 W % of aluminum, 0.7–6.0 W % of zinc, 0.5–5.0 W % of silicon, and 0.025–5.0 W % of phosphorus, and up to 0.7 W % of copper, with the substantial balance being magnesium, whereby the magnesium alloy posses high strength, toughness and elongation.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

The present invention will become more fully understood from the detailed description given hereinbelow and the accompanying drawings which are given by way of illustration only, and thus are not limitative of the present invention, and wherein:

In FIG. 1(C), A is $Mg_{17}Al_{12}$ of FIG. 1A shown in the upper portion of FIG. 1(C) and B is $Mg_2Si$ of FIG. 1B shown in the upper part of FIG. 1(C);

DETAILED DESCRIPTION OF THE PREFERRED EMBODIMENTS

Figure 1A:
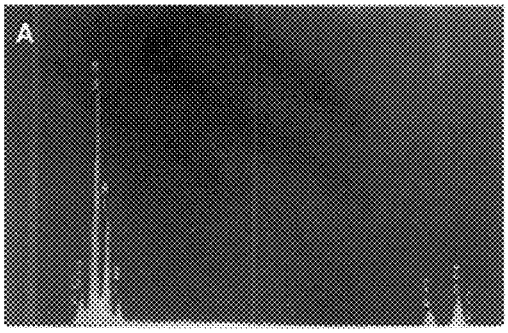
FIG. 1(A) is a photograph using a scanning electron microscope (SEM) showing the micro-structure of the magnesium alloy dispersoid $Mg_{17}Al_{12}$.
Figure 1B:
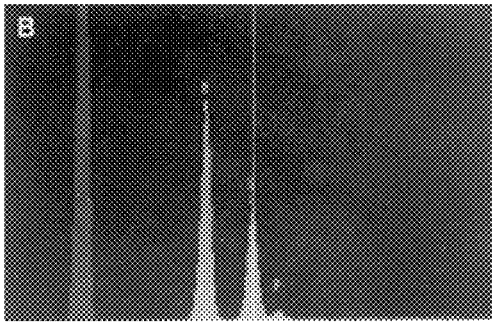
FIG. 1(B) is a photograph using a scanning electron microscope (SEM) showing the micro-structure of the magnesium alloy dispersoid of $Mg_2Si$.
Figure 1C:
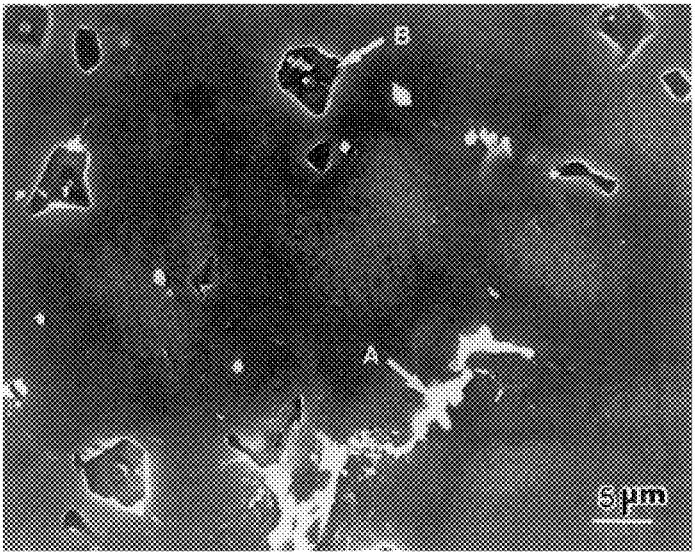
FIG. 1(C) is the combination of FIG. 1(A) and 1(B).
Figure 2A:
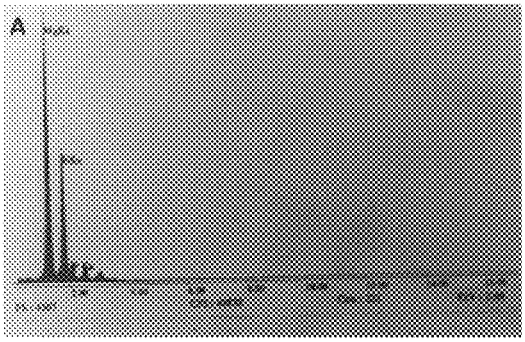
FIG. 2(A) is a photograph using a transmission electron microscope (TEM) showing the micro-structure of a magnesium alloy showing the dispersoid of $Mg_2Si$.
Figure 2B:
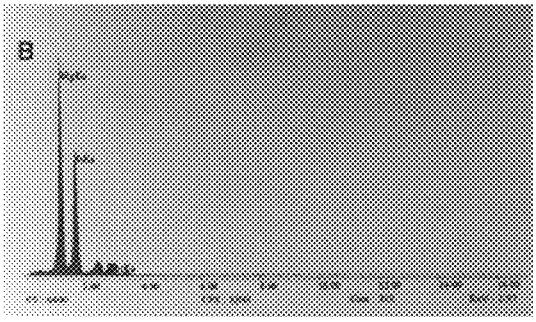
FIG. 2(B) is a photograph using a transmission electron microscope (TEM) showing the micro-structure of a magnesium alloy showing the dispersoid of $Mg_2Si$.
Figure 2C:
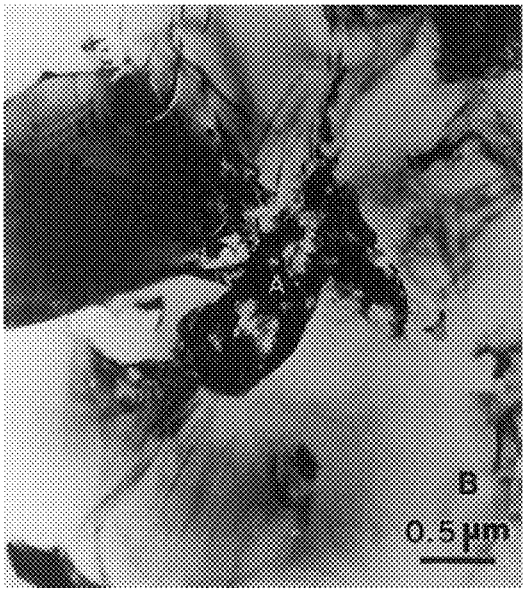
FIG. 2(C) is a detail of FIG. 1(C)'s B portion ($Mg_2Si$)
Figure 3A:
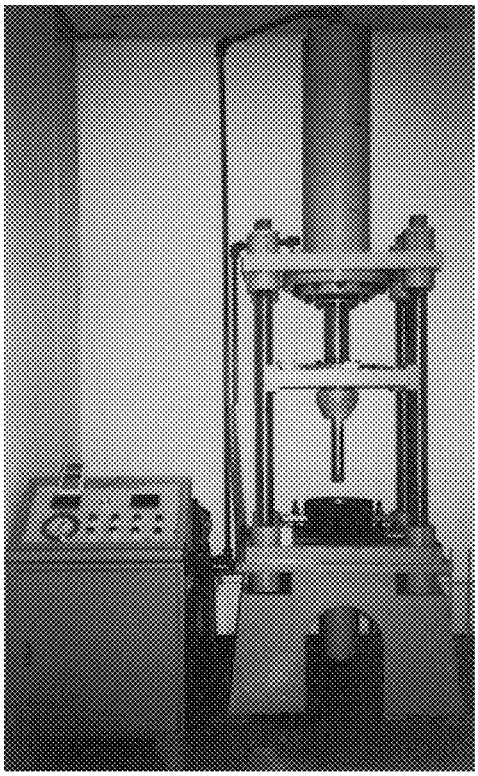
FIGS. 3(A) and 3(B) are front elevation views of a squeeze-casting for casting the magnesium alloy according to the present invention.
Figure 3B:
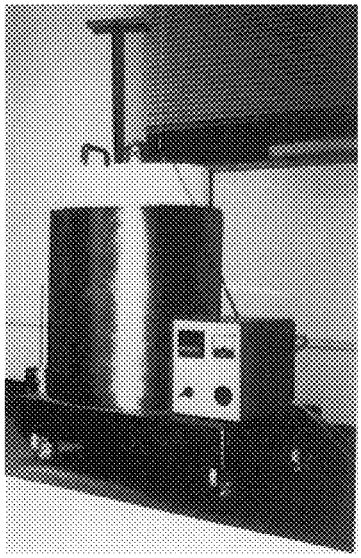
Figure 5:
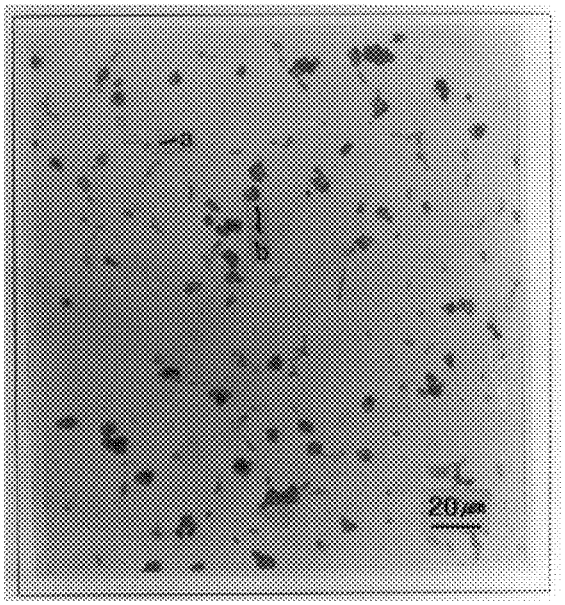
FIG. 5 is a photograph using an optical microscope showing the micro-structure of the magnesium alloy according to the present invention wherein (a) shows $Mg_{17}Al_{12}$ and (b) shows $Mg_2Si$.

Referring now in detail to the drawings for the purpose of illustrating preferred embodiments of the present invention, the magnesium alloy for high pressure casting and the process for the preparation thereof as shown in FIGS. 1 and 2, comprises 4.3–10.0 W % of aluminum, 0.7–6.0 W % of zinc, 0.4–5.0 W % of silicon, 0.025–5.0 W % phosphorus, up to 0.7 W % of copper, with the substantial balance being magnesium.

The addition of phosphorus and copper to the alloy of magnesium, aluminum, zinc and silicon, provides a magnesium alloy with high strength and toughness. The phosphorus provides a core creating position, so that $Mg_2Si$ is produced by centering around the phosphorus. In order to confirm that phosphorus provides the core, a scanning electron microscope (SEM) can be utilized. FIG. 1 shows the result of the observation. In FIG. 1, the center portion of $Mg_2Si$ indicated as (B) shows an opening which is the core creating position when phosphorus can be found.

After $Mg_2Si$ is purified, it is observed by using a transmission electron microscope (TEM), as shown in FIG. 2. That is, $Mg_2Si$ is produced by centering around phosphorus and the $Mg_2Si$ are uniformly scattered in the magnesium alloy according to the present invention.

The phosphorus is present in an amount of 0.025–5.0 W % based on the entire weight of the magnesium alloy. If the amount of the phosphorus is less than 0.025 W %, it is not a reasonable combination with other metals, and if the amount of phosphorus is less than 0.025 W %, the phosphorus cannot satisfy the role of core creation.

Also, the copper is present in an amount of up to 0.7 W % based on the entire weight of the magnesium alloy. In the present invention, in order to prevent evaporation of copper and to add it in a safe way, the copper of the present invention should take the form of an intermetallic compound, e.g. $CU_3P$, which has a low melting point. If the copper is present in an amount of more than 0.7 W %, the magnesium alloy can readily become corroded.

The magnesium alloy of the present invention comprises, except for phosphorus and copper, 4.3–10.0 W % of aluminum, 0.7–6.0 W % of zinc, 0.4–5.0 W % of silicon with the substantial balance being magnesium. When the amount of aluminum is 4.3–10.0 W % based on the entire amount of the magnesium alloy of the present invention, the magnesium alloy of the present invention exhibits a big spherule micro-structure. Products made from this spherule micro-structure are stable structures with excellent elongation. The aluminum takes charge of the role of the formation of the dispersoid of $Mg_{17}Al_{12}$. But if an amount of aluminum is over 10 W %, $Mg_2Si$ forms a big spherule structure. This is a problem since the big spherule micro-structure thus produced cannot be uniformly scattered in the magnesium alloy according to the present invention.

If the amount of aluminum is below 4.3 W %, the magnesium alloy of the present invention has a needle-shaped structure. Such a needle-shaped structure has little elongation but has a high strength. Thus, by adding phosphorus and copper, the disadvantages of $Mg_2Si$ in a needle-shaped structure is controlled, and in a small amount of aluminum. Thus, the phosphorus and copper converts the needle-shaped structure to the spherule structure.

If an amount of zinc is over 6.0 W %, it creates a hot rack. Silicon has the role of making a second dispersoid ($Mg_2Si$). If the amount of silicon is below 0.5 W %, $Mg_2Si$ is precipitated in a small amount and if the amount of silicon is over 5.0 W %, the present magnesium alloy has a different resistant-collusion property.

The magnesium alloy of the present invention is utilized in a high pressure casting method such as a die-casting or a squeeze-casting method as shown in FIGS. (3A) and (B). If the magnesium alloy of the present invention is utilized with a low pressure casting method, the $Mg_2Si$ does not form a needle-shaped structure, and the alloy has a low strength due to the production of regular crystals of silicon.

Figure 4A:
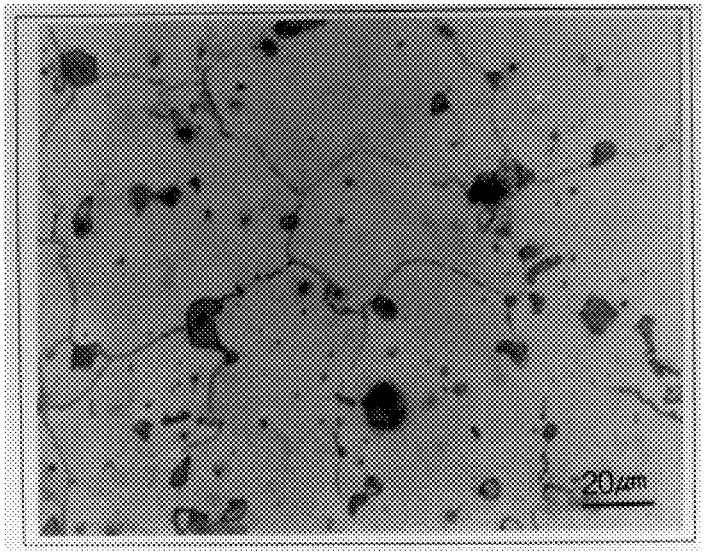
FIG. 4(A) is a photograph using an optical microscope showing a micro-structure of the magnesium alloy of the present invention comprising 9 W % of aluminum, 1 W % zinc and 0.7 W % of silicon processed in a low pressure casting.
Figure 4B:
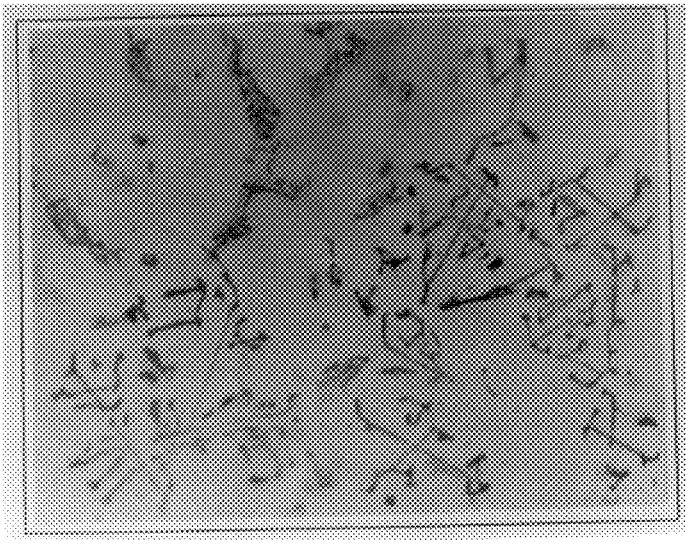
FIG. 4(B) is a photograph using an optical microscope showing a micro-structure of the magnesium alloy of the present invention comprising 9 W % of aluminum, 1 W % zinc and 0.7 W % of silicon processed in a high pressure casting.

As shown FIGS. 4(A) and 4(B), the magnesium alloy of the present invention containing 9 W % of aluminum, 1 W % of zinc and 0.7 W % of silicon is observed by an optical microscope after using the low pressure casting of FIG. 4(A) and the high pressure casting of FIG. 4(B). The magnesium alloy as shown in FIG. 4(B) casted by the high pressure casting, shows higher strength and more excellent elongation than the magnesium alloy as shown in FIG. 4(A) casted by low pressure casting.

The present invention will now be described in more detail in connection with the following examples which should be considered as being exemplary and not limiting the present invention.

EXAMPLE AND COMPARATIVE EXAMPLE

The following magnesium alloys are made using the following ratio of metals alloyed together and the tensile strength, yield strength and elongation are measured and recorded in Table I.

| | Example | Comparative Example 1 | Comparative Example 2 |
|---|---|---|---|
| Aluminum | 4.0 | 9 | 5 |
| Zinc | 1.0 | 1 | 1 |
| Silicon | 0.5 | 0 | 0.7 |
| Phosphorus | 0.03 | 0 | 0 |
| Copper | 0.7 | 0 | 0 |
| Magnesium | Remainder | Remainder | Remainder |
| Tensile Strength (MPa) | 215 | 193 | 194 |
| Yield Strength (MPa) | 125 | 114 | 115 |
| Elongation (%) | 5.8 | 4.3 | 5.6 |

As shown in Table I, a magnesium alloy containing phosphorus and copper according to the present invention possesses excellent high tensile strength, yield strength and elongation.

EXPERIMENTAL EXAMPLE

The magnesium alloy of the above example is observed using an optical microscope and the results of the observation are shown in the drawings That is, in the magnesium alloy according to the present invention, there is formed $Mg_{17}Al_{12}$ as a spherule structure, as shown in the drawings.

The magnesium alloy of the present invention has high strength and high toughness, and when utilized with high pressure casting such as die-casting or squeeze-casting, achieve the highest possible strength and toughness.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A magnesium alloy having a high strength and elongation, comprising by weight, 4.3–10.0% aluminum, 0.7–6.0% zinc, 0.4–5.0% silicon, 0.025–5.0% phosphorus, up to 0.7% copper, with the balance being magnesium.

2. The magnesium alloy of claim 1, wherein said alloy is cast by a high pressure casting procedure.

3. The magnesium alloy of claim 2, wherein said high pressure casting procedure is die-casting.

4. The magnesium alloy of claim 3, wherein said high pressure casting procedure is squeeze-casting.

5. The magnesium alloy of claim 1, wherein copper is present in an amount of 0.1 to 0.7 W %.

6. A process for the preparation of a magnesium alloy having high strength and elongation, which comprises casting a magnesium-based alloy containing zinc, and silicon, and adding thereto phosphorus in an amount of 0.025–5.0 W % and copper in an amount of up to 0.7 W %.

7. The process of claim 6, wherein copper is present in an amount of 0.1 to 0.7 W %.

8. An automobile or airplane part made of a magnesium alloy comprising, by weight, 4.3–10.0% aluminum, 0.7–6.0% zinc, 0.4–5.0% silicon, 0.025 –5.0% phosphorus, up to 0.7% copper, with the balance being magnesium.

* * * * *